US007294970B2

(12) United States Patent
Yang

(10) Patent No.: US 7,294,970 B2
(45) Date of Patent: Nov. 13, 2007

(54) LED DRIVER DEVICE

(75) Inventor: Joon-hyun Yang, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/338,638

(22) Filed: Jan. 25, 2006

(65) Prior Publication Data

US 2006/0186820 A1 Aug. 24, 2006

(30) Foreign Application Priority Data

Feb. 18, 2005 (KR) ..... 10-2005-0013575

(51) Int. Cl.
*H05B 39/04* (2006.01)

(52) U.S. Cl. ..... 315/158; 315/169.3; 315/169.1; 345/204; 345/82

(58) Field of Classification Search ..... 315/158, 315/169.3, 169.1; 345/204, 76–83, 55, 60–63
See application file for complete search history.

(56) References Cited

U.S. PATENT DOCUMENTS 5,257,039 A * 10/1993 Chung et al. ..... 347/237
6,943,761 B2 * 9/2005 Everitt ..... 345/82
6,963,321 B2 * 11/2005 Everitt ..... 345/82

FOREIGN PATENT DOCUMENTS

| | | | |
|---|---|---|---|
| JP | 2000-293119 | A | 10/2000 |
| KR | 1994-0002292 | B1 | 3/1994 |
| KR | 1996-0001558 | Y1 | 2/1996 |

* cited by examiner

*Primary Examiner*—Douglas W. Owens
*Assistant Examiner*—Chuc Tran
(74) *Attorney, Agent, or Firm*—Sughrue Mion, PLLC

(57) ABSTRACT

A light emitting diode (LED) driver drives a plurality of LEDs, and includes a plurality of LED drivers with inherent addresses thereof respectively driving the plurality of LEDs; a serial bus connected to the plurality of LED drivers; and a sequence controller serially transmitting a control signal for driving the plurality of LEDs and the inherent addresses, allowing the plurality of LED drivers to be sequentially driven, in the form of digital data through the serial bus. Thus, the LED driver accomplishes appropriate response speed corresponding to a human eye's recognition limit. Further, the LED driver provides easy fabrication, small size and lower production cost. The LED driver generates less noise while large current and high voltage fluctuate. Also, the LED driver automatically detects malfunction and automates initial current setting for production.

8 Claims, 4 Drawing Sheets

LED DRIVER DEVICE

CROSS-REFERENCE TO RELATED APPLICATIONS

This application claims priority from Korean Patent Application No. 2005-0013575, filed on Feb. 18, 2005, in the Korean Intellectual Property Office, the disclosure of which is incorporated herein by reference.

BACKGROUND OF THE INVENTION

1. Field of the Invention

The present invention relates to a light emitting diode (LED) driver device, and more particularly, to an LED driver device providing appropriate response speed, small size, easy fabrication, lower production costs and less noise.

2. Description of the Related Art

LEDs form a plurality of arrays with respect to three colors of red, green and blue, respectively, to be used as a back light of a liquid crystal display (LCD) apparatus.

As shown in FIG. 1, a conventional driver 200 for driving such an LED includes a dimming amount calculator 202 receiving the average luminance (Y) value of a video signal and calculating the dimming controlling amount of respective RGB colors; a modulation controller 206 receiving the dimming controlling amount, receiving information about the RGB colors inputted from a light sensor 204 and outputting a pulse width modulation signal; a signal shifting part 208 generating a reference timing signal having a phase shifted in sequence to sequentially shift the phase of the pulse width modulation signal with respect to each of the RGB LEDs 250; an AND gate 210 receiving the pulse width modulation signal of the modulation controller 206 and the reference timing signal of the signal shifting part 208 and outputting a signal by a logical AND operation thereof; and a plurality of LED drivers 212 receiving an output signal of the AND gate 210 and driving the LED 250.

If the pulse width modulation signal of the modulation controller 206 is simultaneously applied to the plurality of LED drivers 212 in parallel, large current stress is applied to a power source unit. Hence, the LED driver 200 sequentially applies the pulse width modulation signal to each of LED lines or the drivers.

Then, the signal shifting part 208 generates the reference timing signal having phase difference, as much as the number of the drivers, by using a counter 214 and a shift register 216. When the reference timing signal of the signal shifting part 208 and the pulse width modulation signal of the modulation controller 206 are performed with an AND operation by the AND gate 210, the phase of the pulse width modulation signal is sequentially shifted and the drivers 212 are sequentially driven.

The conventional LED driver 200 employs a field-programmable gate array (FPGA) or a complex programmable logic device (CPLD) in the signal shifting part 208 to achieve fast response of high brightness LED, thereby sequentially dimming at high speed.

However, it is required to slow down the response speed of the light sensor 204 and the modulation controller 206 to the range of 100 ms to 500 ms to prevent drastic color change recognized by human's eye. That is, the response speed of the whole system should be slowed down to maintain stable white balance. Further, the high speed response of the LED may cause adverse effects on the LCD back light. Thus, the dimming control at appropriate speed corresponding to a human eye's recognition limit is more effective than the dimming control using high speed digital logic.

Meanwhile, the conventional LED driver 200 utilizes the signal shifting part 208 as a complex additional logic number to supply information on analog dimming, PWM dimming, etc. to each of the drivers in parallel through an analog signal line, thereby requiring many circuit wires.

Also, in the analog signal line corresponding to a low voltage, much noise may be introduced into the circuit when a large current and a high voltage repeatedly fluctuate, thereby leading to malfunction and abnormal oscillation.

Further, as a main controller of the conventional LED driver 200 does not have a function for determining a current value of the LEDs, the malfunction thereof is not automatically detected, and initial current setting for production cannot be automated.

SUMMARY OF THE INVENTION

Accordingly, it is an aspect of the present invention to provide an LED driver device comprising appropriate response speed corresponding to a human eye's recognition limit.

It is another aspect of the present invention to provide an LED driver device providing easy fabrication, small size and lower production cost.

It is another aspect of the present invention to provide an LED driver device generating less noise while large current and high voltage fluctuate.

It is another aspect of the present invention to provide an LED driver device automatically detecting malfunction and automating initial current setting for production.

According to an aspect of the present invention, there is provided an LED driver device driving a plurality of LEDs, comprising a plurality of LED drivers, each having corresponding addresses and driving the plurality of LEDs; a serial bus connected to the plurality of LED drivers; and a sequence controller serially transmitting a control signal for driving the plurality of LEDs and the addresses allowing the plurality of LED drivers to be sequentially driven in the form of digital data through the serial bus.

According to an aspect of the present invention, each of the plurality of LED drivers comprises a first serial bus interface performing data communication with the sequence controller through the serial bus to receive the digital data corresponding to the control signal and the address; a DA converter performing DA conversion of the digital data to restore the control signal; a switch turned on or off to electrically connect or cut off a predetermined power source unit and the corresponding LEDs; and a switch driver outputting a signal turning on or off the switch according to the control signal.

According to an aspect of the present invention, the control signal comprises a level signal indicating a level of current flowing in the LEDs and a pulse width modulation signal controlling operation of the switch driver, and the respective drivers further comprise a first register and a second register respectively storing the level signal and the pulse width modulation signal.

According to an aspect of the present invention, the control signal further comprises an offset current signal indicating a level of offset current flowing in the LEDs, and the respective drivers further comprise a third register respectively storing the offset current signal.

According to an aspect of the present invention, the drivers further comprise a current detector detecting the current flowing in the LEDs; an AD converter performing AD conversion of the detected current signal; and a fourth register storing the current signal performed with the AD conversion, and the first serial bus interface transmits data of the current signal stored in the fourth register through the serial bus.

According to an aspect of the present invention, the serial bus comprises an inter-integrated circuit (I2C) bus, and the first serial bus interface and the second serial bus interface perform the data communication according to an I2C bus protocol.

According to an aspect of the present invention, the sequence controller comprises a second serial bus interface performing the data communication with the plurality of LED drivers through the serial bus to transmit the control signal and the address in the form of digital data; and an interface controller sequentially changing the address of the plurality of LED drivers and providing the second serial bus interface with the control signal and the address in the form of digital data.

BRIEF DESCRIPTION OF THE DRAWINGS

The above and/or other aspects of the present invention will become apparent and more readily appreciated from the following description of exemplary embodiments, taken in conjunction with the accompanying drawings of which.

DETAILED DESCRIPTION OF EXEMPLARY EMBODIMENTS

Figure 1:
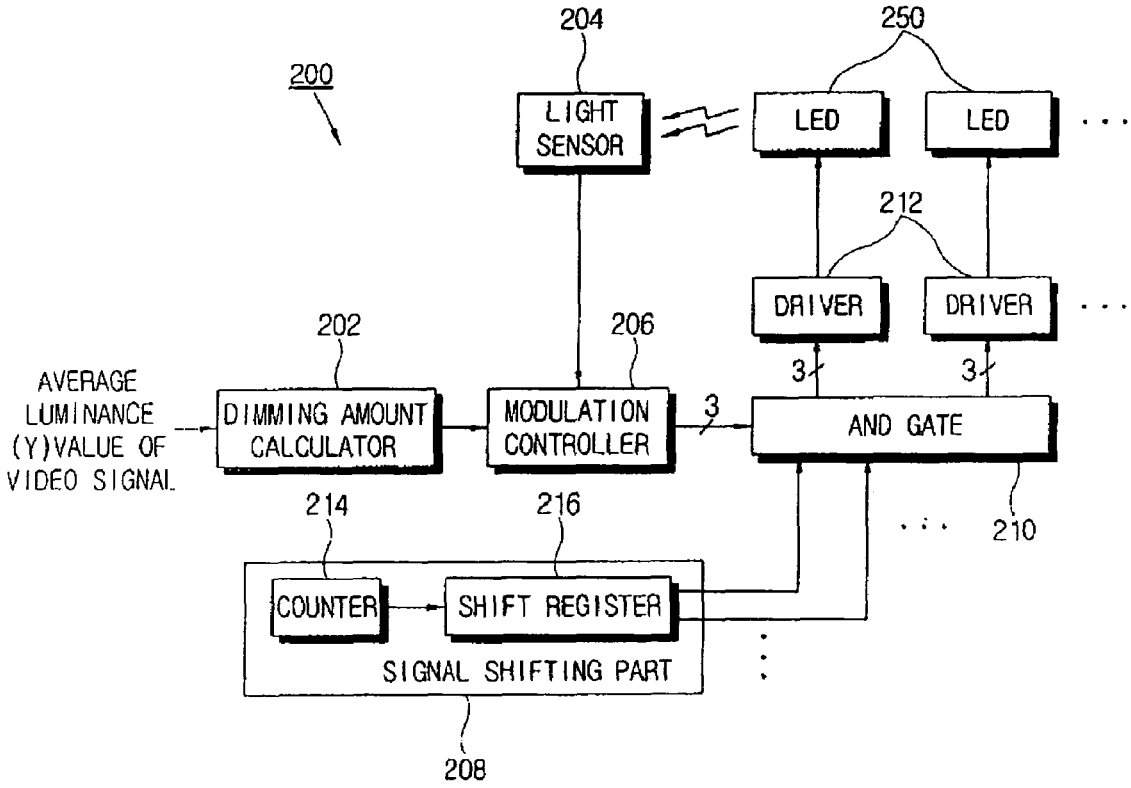
FIG. 1 (PRIOR ART)
FIG. 1 is a block diagram of a configuration of a conventional LED driver.

Reference will now be made in detail to exemplary embodiments of the present invention, examples of which are illustrated in the accompanying drawings, wherein like reference numerals refer to like elements throughout. Exemplary embodiments are described below in order to explain the present invention by referring to the figures.

Figure 2:
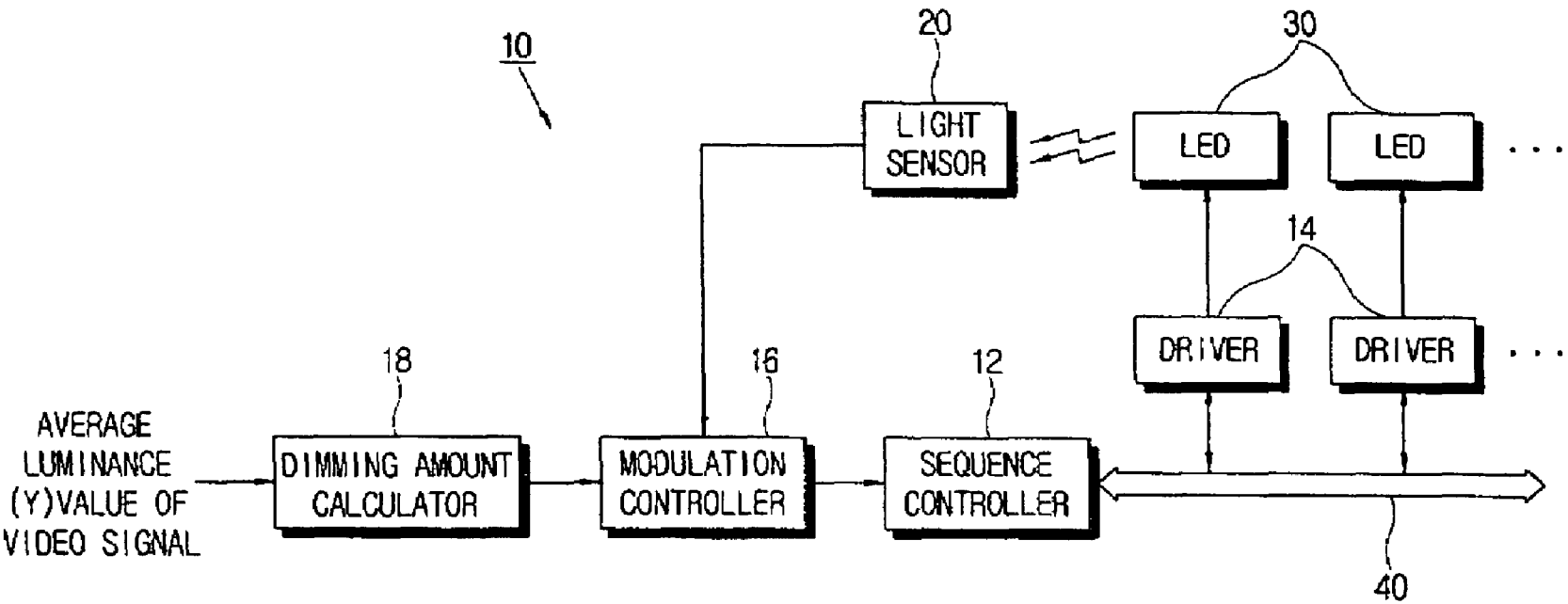
FIG. 2 is a block diagram of a configuration of an LED driver device according to an exemplary embodiment of the present invention.

FIG. 2 is a block diagram schematically illustrating a configuration of an LED driver device 10 according to an exemplary embodiment of the present invention.

The LED driver device 10 according to an exemplary embodiment of the present invention drives a plurality of LEDs 30 used as a back light of an LCD apparatus. The plurality of LEDs 30 are provided with respect to each of RGB (red, green and blue) colors in the present exemplary embodiment.

The LED driver device 10 of the present exemplary embodiment serially transmits a control signal in the form of digital data through a serial bus to control current flowing in the plurality of LEDs 30. Also, the LED driver device 10 of the present exemplary embodiment sequentially changes an address of a driver corresponding to the plurality of LEDs 30 to sequentially drive the plurality of LEDs 30.

As shown in FIG. 2, the LED driver device 10 of the present exemplary embodiment comprises a plurality of LED drivers 14, a serial bus 40 and a sequence controller 12. The plurality of LED drivers 14 and the sequence controller 12 perform data communication with each other through the serial bus 40.

Each of the plurality of LED drivers 14 has a corresponding address, and corresponds to each of the plurality of LEDs 30. The respective drivers 14 receive the control signal and the address from the serial bus 40 to control the current flowing in the plurality of LEDs 30. If the received address conforms to their corresponding addresses, the drivers 14 drive the LEDs 30 corresponding to the control signal. The respective drivers 14 are connected to the serial bus 40 in parallel. Also, the respective drivers 14 are provided with a first serial bus interface 142 (to be described later with reference to FIG. 4) performing the data communication with the sequence controller 12 through the serial bus 40.

The sequence controller 12 serially transmits the control signal and the address in the form of the digital data to the serial bus 40, and sequentially changes the addresses of the plurality of LED drivers 14 to allow the control signal to be sequentially transmitted to the plurality of LED drivers 14.

Figure 3:
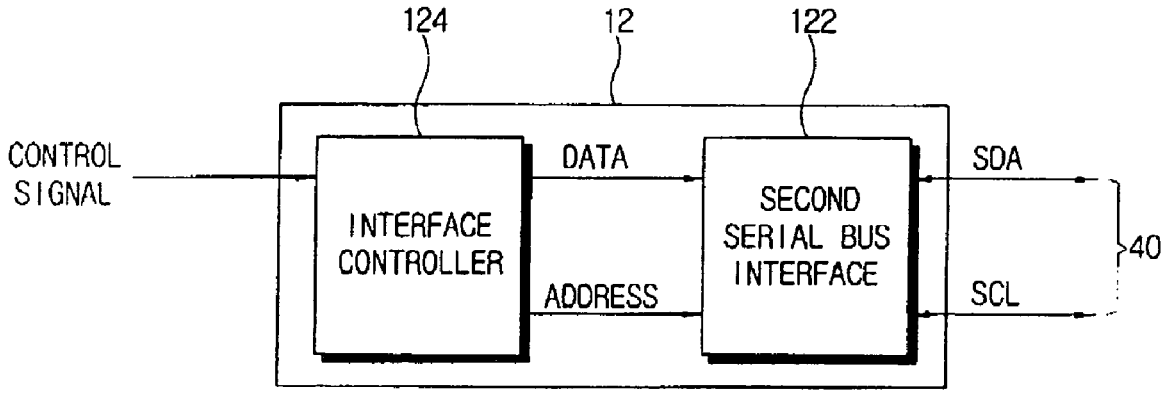
FIG. 3 is a block diagram of an internal configuration of a sequence controller of the LED driver device in FIG. 2 according to an exemplary embodiment of the present invention.

FIG. 3 is a block diagram illustrating an internal configuration of the sequence controller 12 of the present embodiment. As shown therein, the sequence controller 12 of the present exemplary embodiment comprises a second serial bus interface 122 and an interface controller 124.

The second serial bus interface 122 performs the data communication with the plurality of LED drivers 14 through the serial bus 40 to transmit the control signal and the address in the form of the digital data. The serial bus of the present exemplary embodiment comprises an inter-integrated circuit (I2C) bus. It is preferable but not necessary that the second serial bus interface 122 performs the data communication according to an I2C bus protocol.

The second serial bus interface 122 receives data corresponding to the control signal from the interface controller 124 and the address designating the driver 14 to which the control signal is to be transmitted, and transmits the data and the address to the serial bus 40 which comprises a SDA as a data line and a SCL as a clock line according to the I2C bus protocol.

The interface controller 124 sequentially changes the addresses of the plurality of LED drivers 14, and provides the second serial bus interface 122 with the control signal and the sequentially changed address in the form of the digital data. The interface controller 124 stores the addresses of the plurality of LED drivers 14 in a predetermined memory (not shown) in advance, and sequentially changes the addresses of the plurality of LED drivers 14 with respect to a predetermined interval of the control signal and provides them to the second serial bus interface 122.

That is, the interface controller 124 transmits the control signal with a predetermined interval as many times as the number of the drivers 14 while sequentially changing the driver 14 address.

The response speed of the light sensor 20 and the modulation controller 16 which is appropriate for the human eye's recognition limit is approximately 100 ms. In accordance with the response speed, the predetermined interval of the control signal may be fully transmitted to the plurality of LED drivers 14 in a single frame.

Meanwhile, the LED driver device 10 of the present invention may further comprise a dimming amount calculator 18, the modulation controller 16 and the light sensor 20, as shown in FIG. 2.

The dimming amount calculator 18 receives the average luminance (Y) value of a video signal and calculates the dimming amount of the respective RGB colors corresponding thereto. The light sensor 20 senses light emitted from the plurality of LEDs 30 and provides information on each of the RGB colors.

The modulation controller 16 receives the dimming amount of the RGB colors calculated by the dimming amount calculator 18 and the information of the respective RGB colors, and generates the pulse width modulation signal corresponding thereto. The pulse width modulation signal of the present exemplary embodiment is an example of the control signal of the present invention.

The sequence controller 12 of the present exemplary embodiment may be provided with the control signal, i.e. the pulse width modulation signal from the modulation controller 16.

Figure 4:
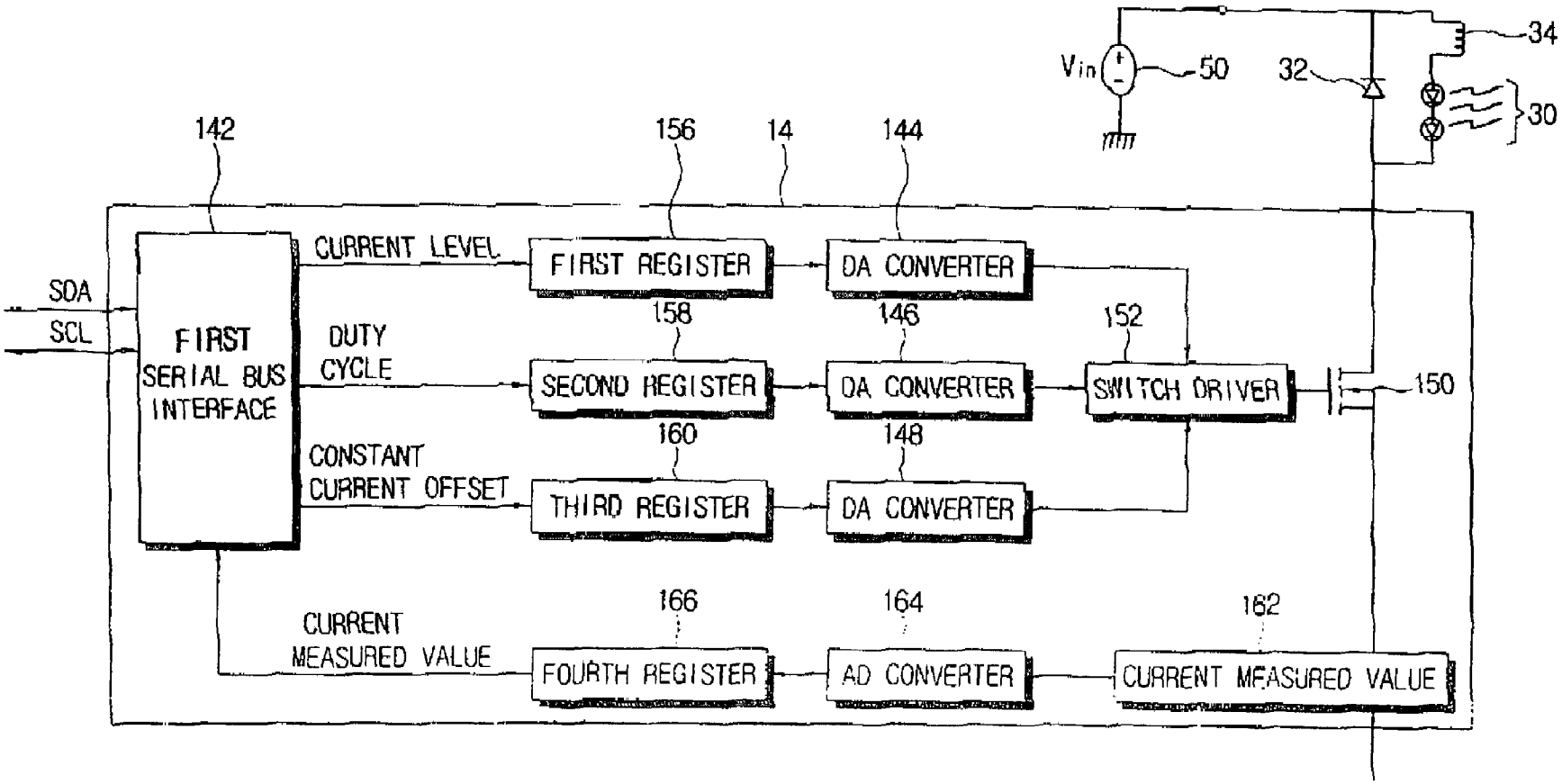
FIG. 4 is a block diagram of an internal configuration of a driver of the LED driver device in FIG. 2 according to an exemplary embodiment of the present invention.

FIG. 4 is a block diagram illustrating an internal configuration of the respective LED drivers 14 according to an exemplary embodiment of the present invention. As shown therein, the respective drivers 14 comprise the first serial bus interface 142, a digital-to-analog (DA) converter 144, 146 and 148, a switch 150 and a switch driver 152.

The first serial bus interface 142 performs the data communication with the sequence controller 12 through the serial bus 40 to receive the digital data corresponding to the control signal and the address. The serial bus 40 of the present exemplary embodiment comprises the I2C bus. It is preferable but not necessary that the first serial bus interface 142 performs the data communication according to the I2C bus protocol.

That is, the first serial bus interface 142 receives the digital data corresponding to the control signal and the address from the serial bus 40, decodes them according to the I2C bus protocol and checks the received address. If the address received from the serial bus 40 conforms to its address, the first serial bus interface 142 continues receiving the data.

The DA converters 144, 146 and 148 perform DA conversion of the digital data and restore the control signal. The switch 150 is turned on or off to electrically connect or cut off a power source unit 50 and the corresponding LEDs 30.

The switch driver 152 outputs a signal to turn on or off the switch 150 according to the control signal, to thereby drive the switch 150.

The control signal of the present exemplary embodiment comprises a level signal indicating a level of the current flowing in the LEDs 30; and the pulse width modulation signal controlling operation of the switch driver 152. Further, the control signal may comprise an offset current signal indicating a level of offset current flowing in the LEDs 30.

The respective LED drivers 14 may further comprise a first register 156, a second register 158 and a third register 160 storing data corresponding to the level signal, the pulse width modulation signal and the offset current signal.

Each of the first, second and third registers 156, 158 and 160 has a corresponding address. The first serial bus interface 142 checks the address about the received digital data according to the I2C bus protocol, and stores the data corresponding to the level signal, the pulse width modulation signal and the offset current signal to the register 156, 158 or 160 having the corresponding checked address.

Further, the respective LED drivers 14 may further comprise a current detector 162 detecting the current flowing in the LEDs 30; and an analog-to-digital (AD) converter 164 performing AD conversion of the detected current signal. At this time, it is preferable but not necessary that the respective drivers 14 further comprise a fourth register 166 storing data corresponding to the AD converted current signal.

If receiving request of transmitting the detected current signal through the serial bus 40, the first serial bus interface 142 transmits the data corresponding to the stored current signal through the serial bus 40 referring to the fourth register 166.

Accordingly, the LED driver device 10 of the present invention provides a detected value of the current flowing in the LEDs 30 to the main controller (not shown), thereby detecting where malfunction happens and automating initial current settings, comprising different current-light output characteristics, of the plurality of LED driving circuits, respectively, during initial production.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A light emitting diode (LED) driver device driving a plurality of LEDs, comprising:

a plurality of LED drivers, which drive the plurality of LEDs, respectively, wherein each of the plurality of LED drivers has a corresponding address;

a serial bus which is connected to the plurality of LED drivers;

a sequence controller which serially transmits a control signal for driving the plurality of LEDs and the corresponding addresses, to allow the plurality of LED drivers to be sequentially driven, in the form of digital data through the serial bus;

a first serial bus interface which performs data communication with the sequence controller through the serial bus to receive the digital data corresponding to the control signal and the corresponding addresses;

a switch which is turned on or off to electrically connect or cut off a predetermined power source unit and the corresponding LEDs; and a switch driver which outputs a signal turning on or off a switch according to the control signal.

2. The LED driver device according to claim 1, wherein each of the plurality of LED drivers comprises: and a digital to analog (DA) converter which performs DA conversion of the digital data to restore the control signal.

3. The LED driver device according to claim 2, wherein the control signal comprises a level signal which indicates a level of current flowing in the LEDs, and a pulse width modulation signal which controls operation of the switch driver, and wherein the respective LED drivers further comprise a first register and a second register which store the level signal and the pulse width modulation signal, respectively.

4. The LED driver device according to claim 3, wherein the control signal further comprises an offset current signal which indicates a level of offset current flowing in the LEDs, and the respective drivers further comprise a third register which stores the offset current signal.

5. The LED driver device according to claim 3, wherein each of the LED drivers further comprise:

a current detector which detects the current flowing in the LEDs;

an analog to digital (AD) converter which performs AD conversion of the detected current signal; and a fourth register which stores the current signal which has been AD converted; and wherein the first serial bus interface transmits data of the current signal stored in the fourth register through the serial bus.

6. The LED driver device according to claim 2, wherein the serial bus comprises an inter-integrated circuit (I2C) bus, and the first serial bus interface and the second serial bus interface perform the data communication according to an I2C bus protocol.

7. The LED driver device according to claim 1, wherein the sequence controller comprises:

a second serial bus interface which performs the data communication with the plurality of LED drivers through the serial bus to transmit the control signal and the address in the form of the digital data; and an interface controller which sequentially changes the addresses which designate the LED drivers and provides the second serial bus interface with the control signal and the sequentially changed addresses in the form of the digital data.

8. The LED driver device according to claim 7, wherein the serial bus comprises an inter-integrated circuit (I2C) bus, and the first serial bus interface and the second serial bus interface perform the data communication according to an I2C bus protocol.

* * * * *